US007317803B1

(12) United States Patent
Prabhakar et al.

(10) Patent No.: US 7,317,803 B1
(45) Date of Patent: Jan. 8, 2008

(54) MEDICINE ADMINISTRATION METHOD

(76) Inventors: Indira C. Prabhakar, 3175 Delevan Dr., Saginaw, MI (US) 48603; Bangalore Prabhakar, 3175 Delevan Dr., Saginaw, MI (US) 48603

( * ) Notice: Subject to any disclaimer, the term of this patent is extended or adjusted under 35 U.S.C. 154(b) by 0 days.

(21) Appl. No.: 09/578,277

(22) Filed: May 25, 2000

(51) Int. Cl.

| | |
|---|---|
| ***G09F 27/00*** | (2006.01) |
| ***G04B 47/00*** | (2006.01) |
| ***G04B 21/08*** | (2006.01) |
| ***G04C 21/00*** | (2006.01) |
| ***G08B 1/00*** | (2006.01) |

(52) U.S. Cl. ..... 381/124; 368/10; 368/63; 368/250; 340/309.5; 340/309.7

(58) Field of Classification Search ..... 368/10, 368/63, 250; 381/124; 340/309.5, 309.7
See application file for complete search history.

(56) References Cited

U.S. PATENT DOCUMENTS

| | | | | |
|---|---|---|---|---|
| 5,646,912 | A * | 7/1997 | Cousin | 368/10 |
| 5,805,051 | A * | 9/1998 | Herrmann et al. | 340/309.4 |
| 5,835,455 | A * | 11/1998 | Hanson et al. | 368/10 |
| 5,894,275 | A | 4/1999 | Swingle | |
| 5,903,869 | A | 5/1999 | Jacobson et al. | |
| 5,950,630 | A | 9/1999 | Portwood et al. | |
| 6,021,902 | A | 2/2000 | Wu | |
| 6,150,942 | A * | 11/2000 | O'Brien | 340/573.1 |
| 6,169,707 | B1 * | 1/2001 | Newland | 368/10 |
| 6,198,383 | B1 * | 3/2001 | Sekura et al. | 340/309.4 |
| 6,198,695 | B1 * | 3/2001 | Kirton et al. | 368/10 |
| 6,560,165 | B1 * | 5/2003 | Barker | 368/10 |
| 2005/0209733 | A1 * | 9/2005 | Gilmore | 700/231 |

* cited by examiner

*Primary Examiner*—Vivian Chin
*Assistant Examiner*—Devona Faulk
(74) *Attorney, Agent, or Firm*—Robert L. Farris; Farris Law, P.C.

(57) ABSTRACT

The medicine administration method employs a reminder device with a digital recorder, a visual display device, an audio speaker, a microphone, a resonator and light, a power supply, a computer processor unit, and appropriate controls encased in a housing. A code signal is entered into the device to open a recording function. An oral reminder message is recorded. A time schedule for playing the reminder message is inserted into the processor. When it is time to play the reminder message, a light is illuminated and a resonator is energized. A play button is pressed and the reminder message is played. Messages that are to be played in the future can be played by entering the time the future message is to be played and then playing the reminder message. After the message is played the current month, date and time is entered.

3 Claims, 2 Drawing Sheets

MEDICINE ADMINISTRATION METHOD

TECHNICAL FIELD

The medicine administration method includes a timer system that provides an audible warning as well as a visual warning when it is time to take medication and that then provides audible instructions in response to a request for the instructions.

BACKGROUND OF THE INVENTION

Doctors prescribe various medications for physical and mental disorders and illnesses. Individuals, who are young and in good health, generally take one medication for short periods of time for a specific health problem. They may for example take a pill every 12 hours for 10 days. It is not too difficult for most relatively healthy individuals to remember to take one pill after breakfast and another pill after dinner for example until the container is empty. Generally there will be no serious problems if the individual fails to take the pill after dinner and ends up taking the pill a few hours late or even skips a pill for 12 hours and then adds an extra half day to the 10 day period specified by the doctor.

Some generally healthy individuals are however extremely busy during some period of time and need reminders to take medication. These individuals may for example be students taking final exams, doctors during internships, farmers at harvest time or engineers during a new product launch. Due to concentration on an important task, busy people can forget to take medications.

Individuals with serious health problems and older people may, under a doctor's orders, take a number of different medications. Some of these medications may be taken once per day, others three times per day and still other every two hours for example. Some medications can be taken together with other medications.

Some medications cannot be taken with another specific medication. There are also medications that require a minimum time between each dose to control the maximum quantity of a chemical that is in the body at any given time.

Doctors find that many patients have difficulty taking medication as prescribed. In addition to the reasons mentioned above, these difficulties can be due to disabilities as well as occasional forgetfulness. Failure to take medications as directed by a doctor can result in serious problems. In some situations doctors have patients admitted to hospitals to ensure that medication is administered in a prescribed sequence following a specific schedule. Hospitalization is expensive and can only be justified for relatively short time periods. Nursing homes are employed for longer time care. Nursing homes are less expensive than hospitals but they are still relatively expensive. A substantial number of people could remain at home and take care of themselves if they could take medications as prescribed by their doctor rather than being confined to a hospital or a nursing home. An aid to maintaining prescription medication compliance can keep some individuals out of a hospital or nursing home.

Small containers can be purchased and used to hold the medications that are to be taken at a given time. For example there could be a first container for the medications to be taken at breakfast, a second container for medications to be taken at lunch time, a third container for dinner time medications, and a fourth container for bedtime medications. Containers for several days can be filled at one time. Such a system can work well for organized individuals who follow substantially the same schedule each day. However if they skip a meal from time to time, are extremely busy or have their schedule interrupted by an activity such as travel, there may not be anything to remind them to take medication at specific times. Occasionally the containers can become mixed up resulting in medications being taken at the wrong time. There is also a lack of verbal reminders and instructions that may be necessary or helpful for some individuals.

SUMMARY OF THE INVENTION

The medication administration method employing a reminder device includes turning the device on and entering an access code. After access is obtained, an oral message identifying the medication and the dosage to be taken is recorded and the time schedule for taking a medication is entered and saved. A signal is generated to alert an individual that it is time to take a medication. Upon request the recorded message starting the medication to be taken and the dosage is played. The signal that is generated when it is time to take a medication is both audible and visual. The reminder device can be used by individuals that need an audible reminder at a set time on a given day in the future.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
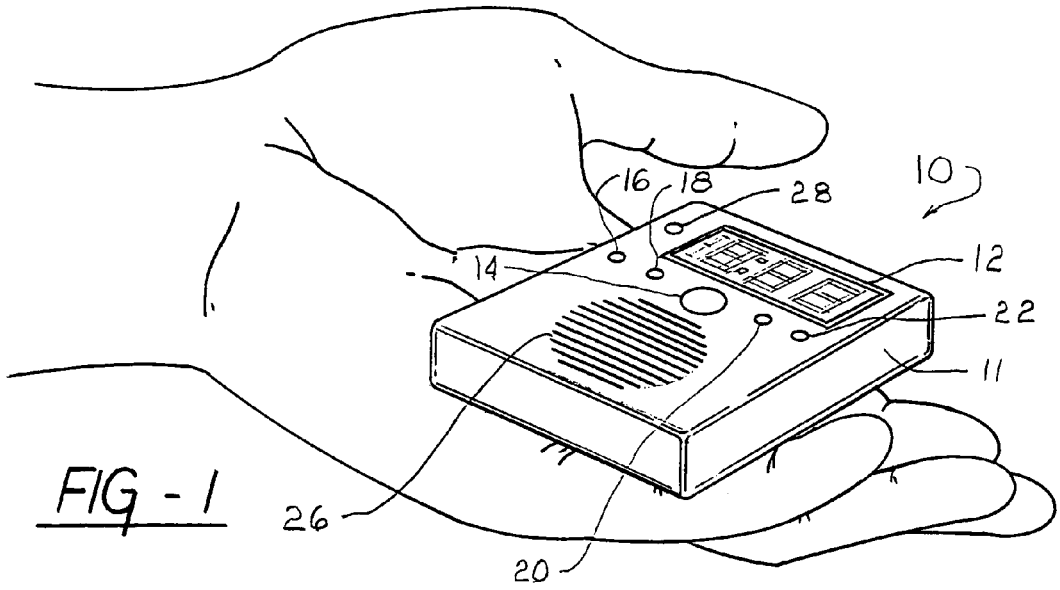
FIG. 1 is a perspective view of the medication reminder device being held in a person's hand.
Figure 2:
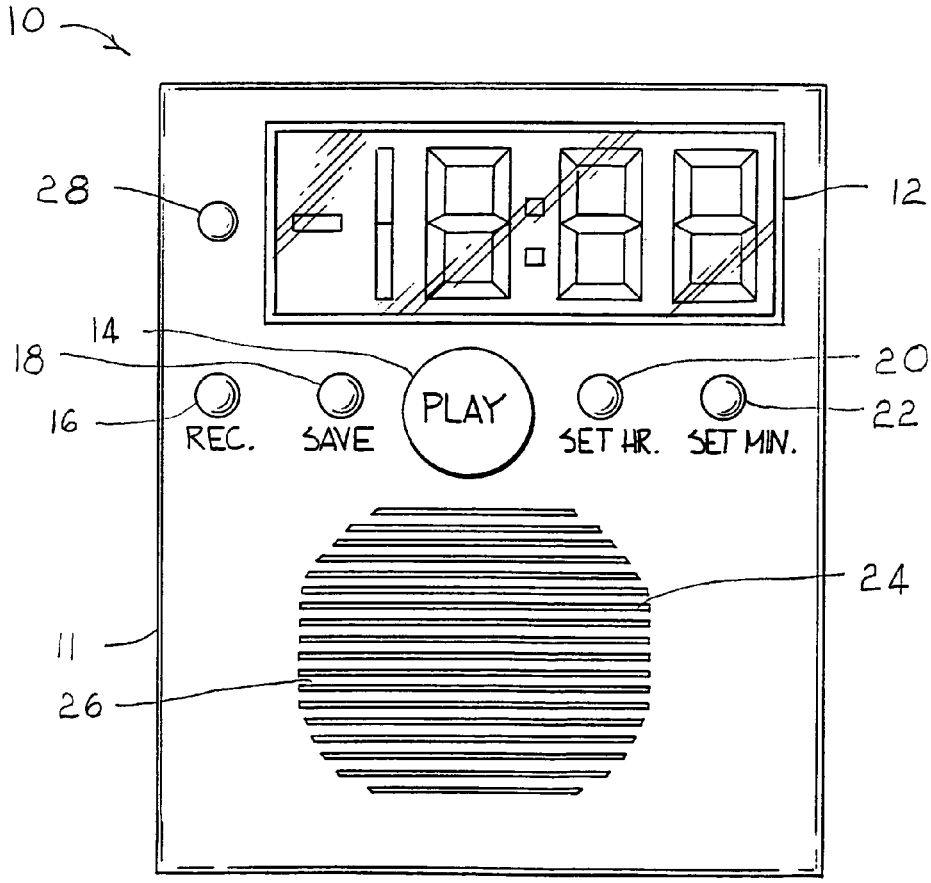
FIG. 2 is an enlarged plan view of a face of the medication reminder device.

The medication reminder device 10 has a case 11 which is generally rectangular. A display unit 12 indicates the month and date when first turned on by pressing the play button 14. After a delay, the time in hours and minutes is displayed. A record button 16, a save button 18, an hour set button 20 and a minute set button 22 are also provided. The hour set button 20 becomes a month set button and the minute set button 22 becomes a date set button when switched to a month and date mode. An audio speaker 24 is protected by a grill 26 below the play button 14. A light 28 is provided on one side of the display unit 12. A microphone 29 is also provided behind the grill 26. A resonator 30 is mounted inside the case 11.

During use of the medication device 10, an audible signal is generated by the resonator 30 and the light 28 starts to blink when it is time to take a medication. The audible signal preferably sends sounds for a few seconds and then shuts off. If desired the resonator 30 can be turned on and off periodically for a period of time. After the audible signal from the resonator 30 is turned off, the light 28 continues to blink. The blinking continues until the play button 14 is pushed. Pressing the play button 14 turns off the resonator 30 and the light 28 and plays an audible recorded message identifying the medications and the dosages that are to be taken at the time. After a brief delay a person can press the play button 14 a second time and the audible message will be played again. After a somewhat longer delay the system is automatically turned off. The device can be turned on again by pressing the play button 14.

The next time a medication is to be taken the small resonator 30 will provide an audible signal and the above procedure will be repeated.

A person employing the medication reminder device 10 will, it is expected, keep the device with him at all times. There should not therefore be an accidental failure to take medication. The reminder device can be provided with an optional capability to handle missed medication periods. If a person having a reminder device with the optional capability should, for any reason, fail to play the medication instructions for a predetermined period of time, the next time instructions are played, the message that is played will identify the medications that can be taken. A new message will indicate which medications are not to be taken and/or direct the person to call his doctor or pharmacist for instructions.

The medication reminder device 10 is capable of providing reminders and instructions for medications with an interval of one month or less between doses.

The medication reminder device 10 is programmable for each medication that is to be taken. The message identifies each medication in sufficient detail for the person to select the correct medication. Special instructions, such as "take before eating", can be included if required. A message is repeated each time a medication covered by the message is to be taken.

A medication reminder device 10 with optional capabilities can provide additional information. For example, if there has been too long a delay between the intended ingestion time and the actual play time of the message, warnings followed by emergency instructions are played.

Medication instruction messages and times are added, deleted or modified by turning the message device on and entering a security code. The security code is entered by pressing the designated instruction buttons 14-20. After the security code is accepted the record button and the save button are activated for their labeled functions and the programming can be modified. New instructions can be added, obsolete messages can be deleted and other messages can be amended. Adding a message concerning an added medication is a two step process. The oral message including the medication and the dosage is added followed by the times the medication is to be taken.

Some individuals will program the medication reminder device 10 themselves. Other individuals will have their doctor or pharmacist program the reminder device. The instructions on the medication container will include the required information for programming the reminder device in most situations. The doctor or pharmacist will have to provide special instructions if any that apply when the medication reminder device 10 has the optional capability and a medication has not been taken during the specified time.

Figure 3:
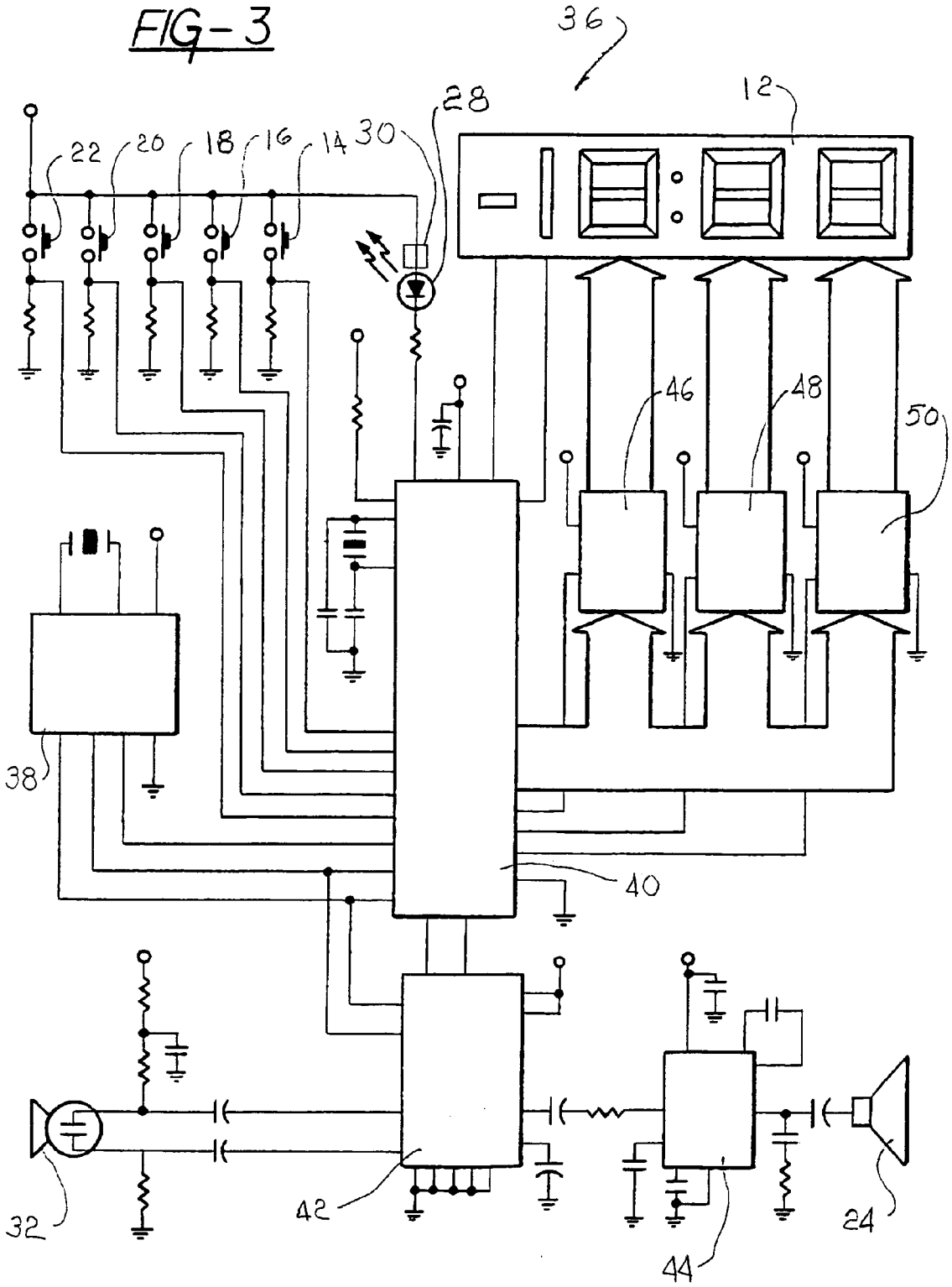
FIG. 3 is a circuit diagram of the medication reminder device.

A circuit diagram 36 for the medication reminder device 10 is shown in FIG. 3. The switches 14-22, the display unit 12, the light 28, the resonator 30, the microphone 32 and the speaker 24 discussed above are all included in the circuit diagram. The circuit diagram 37 also includes a power supply 38. The power supply 38 includes a rechargeable battery, and a battery charger. A computer processor unit 40 is powered by the power supply 38, receives control signals from the switches 14-22 and sends control signals to the display unit 12, the light 28, the resonator 30 and the voice recorder 42. The voice recorder 42 is a digital unit that receives oral messages from the microphone 32 and records the messages. Following receipt of signals from the processor unit 40, the recorder 42 sends recorded messages to the amplifier 44. The amplifier 44 sends the messages to the speaker 24. Display drivers 46, 48 and 50 receive inputs from the computer processor unit 40 and activates the display unit 12 to display months, days, hours and minutes.

The capabilities of the medication reminder device 10 can be increased by increasing the storage capacity of the voice recorder 42 and the capacity of the computer processor unit 40. With increased capacity, additional messages relating to failures to take medication at prescribed times can be added. Increased capacity would also permit a nursing staff to display medications for a number of patients in a hospital or nursing home and reduce the possibility of mistakes. Increased capacity would also permit the medication reminder device to be used as an "audio secretary". The "audio secretary" can play recorded reminders to take some action at a specified time in the future. The recorded reminders for busy professionals, executives, students and others could supplement reminders to take medication or they could in place of reminders to take medication. Messages can be entered for reminders that are to be played up to 60 days in the future.

Frequently persons using the medication reminder device 10 for medication compliance or as an audio secretary needs to know what is recorded for a future date. If the person is planning a trip for example, a list of the medications to be taken during the trip and/or conflicts with previously scheduled and recorded appointments need to be determined. This information can be obtained by changing the month and date to correspond with the proposed trip date and then pressing the play button to play the recorded messages for the date specified. After the messages have been played, the month and day are changed back to the current month and day. In the event that the planned trip is to last more than one day, it is necessary to follow the above procedure for each day. The recorded messages for each twenty-four hour period are playable following the above procedure. The time period can be changed to a one hour period for use in situations in which the twenty-four hour period includes a large number of recorded messages.

This disclosure is representative of presently preferred embodiments of the invention, but is intended to be illustrative rather than definitive thereof. The invention is defined in the claims.

We claim:

1. A medication administration method employing a medication reminder device comprising:

turning the medication reminder device on;

entering a code that provides access to a recording function;

recording an oral message in the medication reminder device that identifies a medication and the dosage to be taken;

entering a month, date and time of day schedule in the medication reminder device for taking a medication;

saving the oral message and the month, date and time of day schedule;

generating a signal to alert an individual that it is time to take a medication;

playing the recorded oral message upon activation of the medication reminder device by pressing a play button;

recording a warning message instructing a person of the action to be taken when an identified medication is not taken within a predetermined time period following the month, date and time of day schedule for taking the identified medication;

playing said warning message when the oral message relating to the identified medication is not played within the predetermined time period; and turning off said signal to alert an individual in response to playing the oral message.

2. A medication administration method as set forth in claim 1 including: recording a second oral message in the medical reminder device that identifies a second medication and the dosage to be taken; entering a second month, date and time of day schedule in the medication reminder device; saving the second oral message and the second month, date and time of day schedule; and playing the second recorded oral message upon activation of the medication reminder device by pressing the play button following the beginning of a month, date and time of day period for taking the second medication.

3. A medication administration method as set forth in claim 1 including:

changing a current month, date and time display by the medication reminder device to a future period;

playing the messages recorded for the future period; and changing the month, date and time to the current month, date and time.

* * * * *